US006715369B2

(12) United States Patent
Baba et al.

(10) Patent No.: US 6,715,369 B2
(45) Date of Patent: Apr. 6, 2004

(54) HYBRID PIPETTE

(75) Inventors: Nobuyuki Baba, Tokyo (JP); Masashi Kobayashi, Tokyo (JP)

(73) Assignee: Nichiryo Co., Ltd., Tokyo (JP)

( * ) Notice: Subject to any disclaimer, the term of this patent is extended or adjusted under 35 U.S.C. 154(b) by 83 days.

(21) Appl. No.: 09/919,796

(22) Filed: Aug. 2, 2001

(65) Prior Publication Data

US 2002/0020233 A1 Feb. 21, 2002

(30) Foreign Application Priority Data

Aug. 3, 2000 (JP) ..... 2000-235793

(51) Int. Cl.[7] ..... B01L 3/02
(52) U.S. Cl. ..... 73/864.16
(58) Field of Search ..... 73/864.16–864.18, 73/864.13; 422/100, 926

(56) References Cited

U.S. PATENT DOCUMENTS 3,915,651 A * 10/1975 Nishi ..... 73/864.16
4,091,677 A * 5/1978 Oshikubo ..... 73/864.15
4,369,665 A * 1/1983 Citrin ..... 73/864.18
4,616,514 A * 10/1986 Magnussen, Jr. et al. 73/864.16
4,988,481 A * 1/1991 Jarvimaki et al. ..... 73/864.16
5,002,737 A * 3/1991 Tervamaki ..... 73/864.18
5,360,596 A * 11/1994 Pennatto ..... 422/100

* cited by examiner

*Primary Examiner*—Thomas P. Noland
(74) *Attorney, Agent, or Firm*—Wenderoth, Lind & Ponack, L.L.P.

(57) ABSTRACT

A hybrid pipette including a pipette casing (11) and a slide shaft (22) vertically movable in response to the operation of a pushbutton (23). A plunger (31) is disposed below the slide shaft and urged upwardly by a spring (33, 34). An engagement member (41) is coaxially and movably fitted on the slide shaft (22) and extends through a hole (**12*a*1) in a casing member (11) so as to be movable at least vertically. An electric motor (51) is provided on an axis different from the axis of the slide shaft and operatively engaged with the engagement member (41). In a manual operation mode, the slide shaft (22) and the plunger (31) move vertically in response to the operation of the pushbutton (23) to perform suction and discharge of a liquid. In a motor-driven operation mode, the engagement member (41) is driven to move vertically by the electric motor (51), whereby the plunger (31**) is moved vertically to perform suction and discharge of a liquid.

12 Claims, 15 Drawing Sheets

HYBRID PIPETTE

BACKGROUND OF THE INVENTION

The present invention relates to a hybrid pipette usable in either of two operating modes, i.e. a manual operation mode and a motor-driven operation mode, by switching between the two modes at will.

Pipettes are roughly divided into two types according to their operating methods, i.e. hand-operated (manual) pipettes and motor-driven pipettes. The manual pipettes provide high reliability with a simple structure and allow the suction/discharge speed to be controlled delicately and hence exhibit high accuracy and superior reproducibility even when pipetting liquids having different volumes and also pipetting liquids having different viscosity. Moreover, the costs are favorably low. Therefore, the manual pipettes are in widespread use.

On the other hand, with the motor-driven pipettes, it is difficult to control the suction/discharge speed delicately in the pipetting operation. Conversely, the operation of the pipettes is constant and stable. In addition, the motor-driven pipettes have an advantage in that they do not require much physical strength even when used for a long period of time.

However, the manual pipettes may cause differences in manual operation among individuals and require some practice to perform a stable pipetting operation. Moreover, a great deal of physical strength is needed to treat a large number of specimens. In addition, the manual pipettes perform only simple pipetting operation and do no include various other functions.

The motor-driven pipettes can solve the problems caused by the manual pipettes but are incapable of delicately controlling a pipetting operation. That is, it is difficult to use them in a manner other than the predetermined manner of using. Furthermore, the production cost is unfavorably high, and the motor-driven pipettes cannot continuously be used for a long period of time because of the limited battery lifetime.

SUMMARY OF THE INVENTION

Accordingly, an object of the present invention is to provide a hybrid pipette selectively usable in either of two operating modes, i.e. a manual operation mode and a motor-driven operation mode, so that it becomes possible to control a pipetting operation delicately in the manual operation mode and it is also possible to perform a stable pipetting operation and to treat a large number of specimens in the motor-driven operation mode.

Another object of the present invention is to provide a hybrid pipette made selectively usable in either of the above two operating modes simply by providing a single engagement member.

Still another object of the present invention is to provide a hybrid pipette in which an electric motor and a slide shaft are provided on different axes, so that it is possible to readily provide a brake mechanism for braking the rotation of the electric motor and a transmission gear mechanism for decelerating the rotation of the electric motor.

A further object of the present invention is to provide a hybrid pipette in which an electric motor and a slide shaft are coaxially provided, so that it is possible to reduce the diameter of the pipette itself and hence possible to reduce the overall size of the hybrid pipette.

A still further object of the present invention is to provide a hybrid pipette in which in the motor-driven operation mode in particular, a tubular threaded member, a slide shaft and a plunger move downward in a state where the relative position of the three members is kept constant, so that there is no need to apply compressive force to a spring provided between the slide shaft and the plunger, whereby the driving torque of the electric motor can be reduced correspondingly.

According to a first aspect thereof, the present invention provides a hybrid pipette including a pipette casing and a slide shaft that is vertically movable in response to the operation of a pushbutton. A plunger is disposed below the slide shaft and urged upwardly by a spring. An engagement member is coaxially and movably fitted on the slide shaft and extends through a hole of the pipette casing so as to be movable at least vertically. An electric motor is provided on an axis different from the axis of the slide shaft and operatively engaged with the engagement member. In a manual operation mode, the slide shaft and the plunger move vertically in response to the operation of the pushbutton to perform suction and discharge of a liquid. In a motor-driven operation mode, the engagement member is driven to move vertically by the electric motor, whereby the plunger is moved vertically to perform suction and discharge of a liquid.

Preferably, the engagement member is a tubular threaded member having an external thread on the outer periphery thereof, and the hole of the pipette casing is an internally threaded hole. The tubular threaded member is in thread engagement with the internally threaded hole. The tubular threaded member is driven to rotate by the electric motor, thereby moving vertically through thread engagement with the internally threaded hole.

Preferably, the engagement member is a rack member having an axially extending rack on the outer periphery thereof. The rack member extends through the hole of the pipette casing and is moved vertically by a pinion driven by the electric motor.

Preferably, a transmission gear mechanism is provided between the electric motor and the engagement member.

Preferably, the electric motor is a direct-current motor and provided with a brake mechanism, or said electric motor may otherwise be a pulse motor.

Preferably, the hybrid pipette further includes a battery for driving the electric motor.

The hybrid pipette according to the first aspect of the present invention provides the following advantages.

Because a single pipette is selectively usable in either of two operating modes, i.e. a manual operation mode and a motor-driven operation mode, it is possible to control pipetting operation delicately in the manual operation mode and it is also possible to perform stable pipetting operation in the motor-driven operation mode. Moreover, because the motor-driven operation mode does not require much physical strength, it is possible to treat a large number of specimens easily.

It is only necessary to provide a single engagement member to attain a pipette which is selectively usable in either of two operating modes, i.e. a manual operation mode and a motor-driven operation mode. Therefore, the arrangement of the pipette is extremely simple.

Furthermore, because the electric motor and the slide shaft are provided on different axes, it is possible to readily provide a brake mechanism for braking the rotation of the electric motor and a transmission gear mechanism for decelerating the rotation of the electric motor. Accordingly, the hybrid pipette has wide applicability.

According to a second aspect thereof, the present invention provides a hybrid pipette including a pipette casing and a slide shaft that is vertically movable in response to the operation of a pushbutton. A plunger is disposed below the slide shaft and urged upwardly by a spring. An electric motor is provided in coaxial relation to the slide shaft. A tubular threaded member with an external thread on the outer periphery thereof is coaxially and movably fitted on the slide shaft and vertically movably extends through a central internally threaded hole in the electric motor. In a manual operation mode, the slide shaft and the plunger move vertically in response to the operation of the pushbutton to perform suction and discharge of a liquid. In a motor-driven operation mode, the tubular threaded member is driven to move vertically by the electric motor, whereby the plunger is moved vertically to perform suction and discharge of a liquid.

Preferably, the electric motor is a direct-current motor and provided with a brake mechanism, or said electric motor may otherwise be a pulse motor.

Preferably, the hybrid pipette further includes a battery for driving the electric motor.

The hybrid pipette according to the second aspect of the present invention provides the following advantage in addition to the above-described advantages.

When the electric motor and the slide shaft are coaxially provided, the tubular threaded member also severs as a rotor of the motor. Therefore, it is possible to simplify the arrangement and to reduce costs. Furthermore, it is possible to reduce the diameter of the pipette itself and to minimize the overall size of the hybrid pipette.

According to a third aspect thereof, the present invention provides a hybrid pipette including a pipette casing and a slide shaft vertically movable in response to the operation of a pushbutton. A plunger is disposed below the slide shaft. The plunger is vertically movable together with the slide shaft as one unit. An electric motor is provided in coaxial relation to the slide shaft. The electric motor has an internally threaded hole. A tubular threaded member with an external thread on the outer periphery thereof is coaxially and movably fitted on the slide shaft and is thread-engaged with the internally threaded hole in the electric motor to allow said slide shaft to move vertically. At least one spring is interposed between a predetermined position on the slide shaft and the tubular threaded member to urge the slide shaft and the plunger upwardly so that a predetermined portion of the slide shaft or the plunger abuts against a predetermined portion of the tubular threaded member or the pipette casing. In a manual operation mode, the slide shaft and the plunger move vertically in response to the operation of the pushbutton to perform suction and discharge of a liquid. In a motor-driven operation mode, the tubular threaded member is driven to move vertically by the electric motor, whereby the plunger is moved vertically to perform suction and discharge of a liquid.

Preferably, the at least one spring is interposed between the upper end of the tubular threaded member projecting above the electric motor and an upper portion of the slide shaft within the pipette casing. However, the present invention is not necessarily limited to this arrangement. The at least one spring may be interposed between a predetermined portion of the tubular threaded member and a predetermined portion of the slide shaft or the plunger below the electric motor.

Preferably, the slide shaft and the plunger are fabricated integrally as a single member.

Alternatively, the slide shaft and the plunger may be fabricated as separate members and joined together as one unit by screwing one of them into the other or by using a pin.

The hybrid pipette according to the third aspect of the present invention provides the following advantages in addition to the above-described advantages.

In the motor-driven operation mode in particular, the tubular threaded member, the slide shaft and the plunger move downward in a state where relative position of said three members is kept constant. Accordingly, there is no need to apply compressive force to the spring provided between the slide shaft and the plunger. Therefore, the driving torque of the electric motor can be reduced correspondingly. Thus, it is possible to reduce the size of the electric motor and to minimize the overall size of the hybrid pipette and hence possible to increase the lifetime of the battery for driving the motor.

Accordingly, it has become possible to use a pulse motor as an electric motor which can present relatively small driving torque, thereby presenting large selectivity of motors. In addition, when a pulse motor is used, there is no need to use a brake mechanism, thereby capable of further minimizing the size of the hybrid pipette.

If the slide shaft and the plunger are prepared as separate members and then joined together, the pipette assembling operation is facilitated.

Preferably, the electric motor is a direct-current motor and provided with a brake mechanism, or said electric motor may otherwise be a pulse motor.

The above and other objects, features and advantages of the present invention will become more apparent from the following description of the preferred embodiments thereof, taken in conjunction with the accompanying drawings.

DETAILED DESCRIPTION OF THE INVENTION

Figure 1:
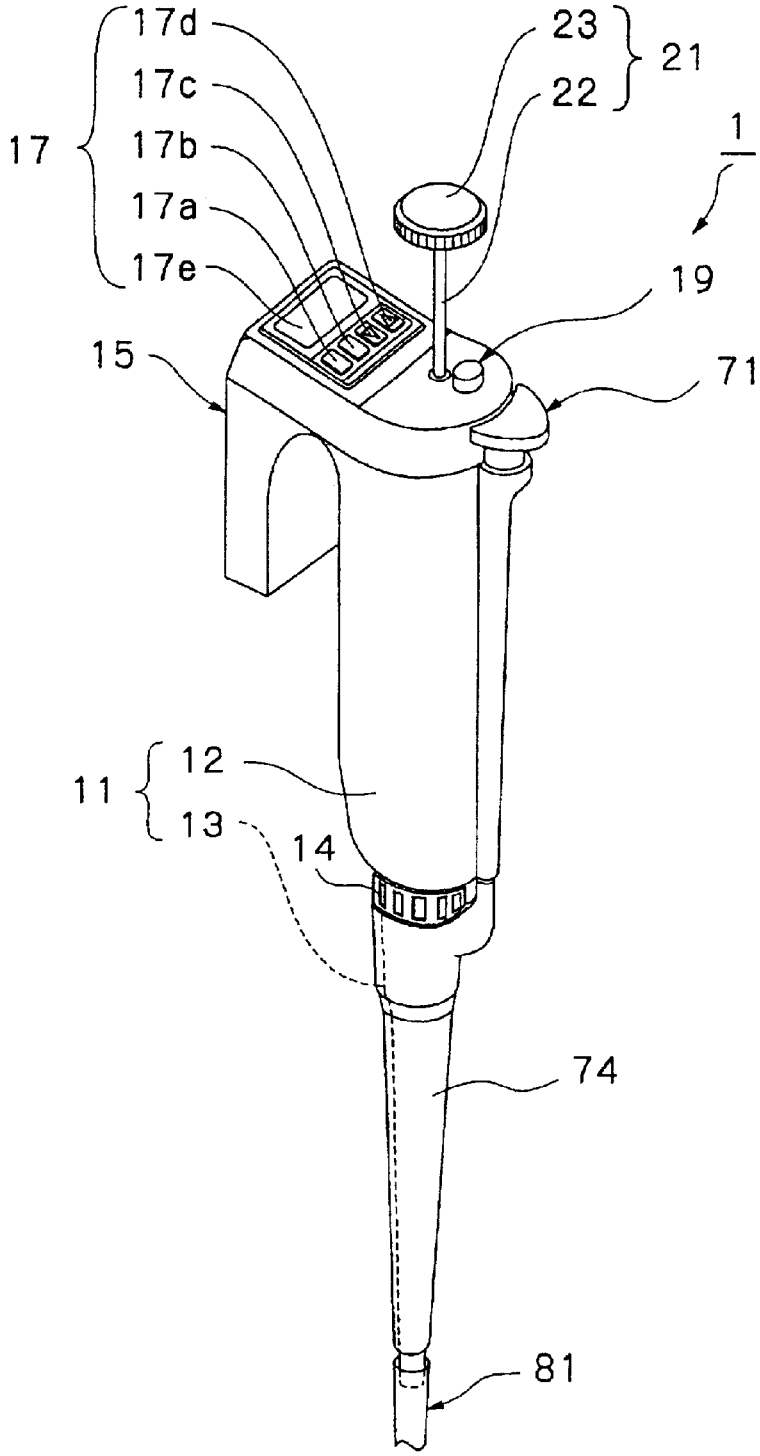
FIG. 1 is a perspective view showing a first embodiment of the hybrid pipette according to the present invention.
Figure 2:
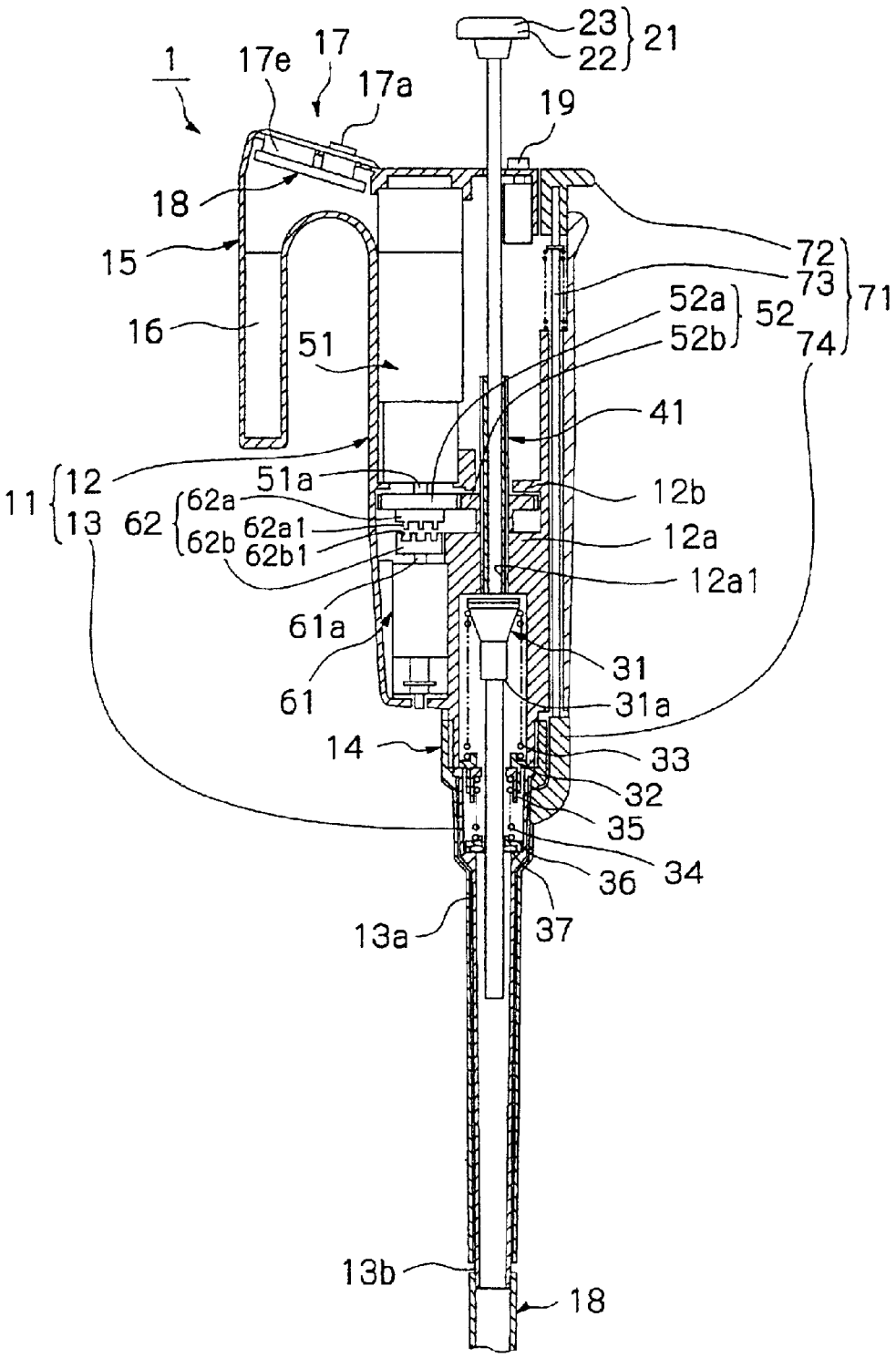
FIG. 2 is a vertical sectional view showing the hybrid pipette of FIG. 1 in its initial position.

FIG. 1 is a perspective view of a first embodiment of the hybrid pipette according to the present invention. FIG. 2 is a vertical sectional view of the embodiment.

In the figures, a hybrid pipette 1 as used in a manual operation mode operates as follows. A pushbutton slide assembly 21 provided in a casing 11 is repeatedly moved downward through a predetermined distance by manual operation. Each time the pushbutton slide assembly 21 is pushed down, the pushbutton slide assembly 21 and a plunger 31 apparently move downward as one unit, causing a predetermined amount of sample liquid to be discharged from a tip 81 attached to a nozzle portion 13*b* at the lower end of the casing 11. In this way, pipetting operation is performed. When the hybrid pipette 1 is used in a motor-driven operation mode, a tubular threaded member 41, which is in thread engagement with the casing 11, is driven to rotate by an electric motor 51 and thus moves downward. Consequently, the plunger 31 apparently moves downward together with the threaded member 41 as one unit, similar to the case of the above-described manual operation mode, causing a predetermined amount of sample liquid to be discharged from the tip 81. Thus, pipetting operation is performed in the same way as the above.

Figure 3:
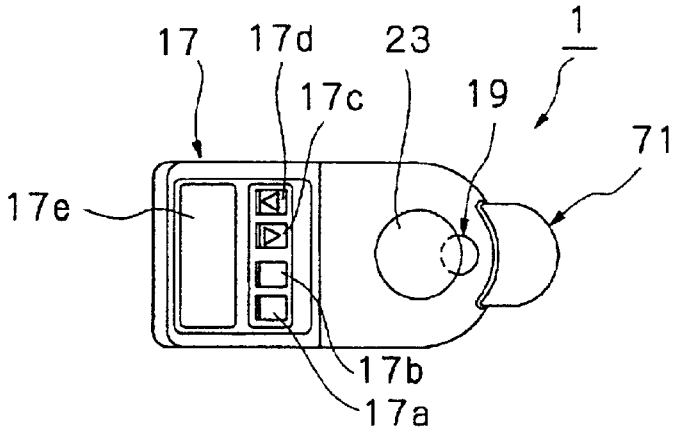
FIG. 3 is a plan view of the hybrid pipette shown in FIG. 1.

The casing 11 consists essentially of an upper tubular casing member 12 (having two intermediate shelf portions 12*a* and 12*b* and an internally threaded through-hole 12*a*1 in the shelf portion 12*a*) made of a resin material and having an oval sectional configuration and a lower tubular cylinder-nozzle casing member 13 made of a resin material. The upper and lower casing members 12 and 13 are secured to each other with a fixing nut 14. A cap 15 for accommodating a panel 17 and a battery 16 is mounted on the top of the upper casing member 12. A battery 16 for driving a motor 51 is provided in the cap 15. Further, a control panel 17 is provided on the top of the cap 15. The control panel 17 (see FIGS. 3 and 6) is provided with a power switch 17*a*, a speed control switch 17*b*, a pipetting volume increase setting switch 17*c* and a pipetting volume decrease setting switch 17*d*, together with a liquid crystal screen 17*e* for displaying the state of these switches. Reference numeral 18 denotes a main control unit (see FIG. 6), and reference numeral 19 denotes a suction/discharge operation switch used in the motor-driven operation mode. It should be noted that the battery 16 may be either a storage battery or a dry cell. Alternatively, the battery 16 may be an AC-DC converter connected to a commercial AC power supply. Both a battery and an AC-DC converter may be provided so as to be selectively usable by switching between them appropriately.

The pushbutton slide assembly 21 consists essentially of a slide shaft 22 and a pushbutton 23 secured to the top of the slide shaft 22.

The plunger 31 is accommodated in the casing 11 to extend over from the upper casing member 12 to the lower cylinder-nozzle casing member 13. The plunger 31 is constantly urged upwardly by a first-stage spring 33 interposed between the plunger 31 and a spring retainer 32 fixedly accommodated in the casing 11. In an initial state where a maximum suction/discharge volume is set, the plunger 31 abuts on the lower surface of the upper casing shelf portion 12*a*. A second-stage spring 34 is interposed between an upper spring retainer 35 and a lower spring retainer 36 below the first-stage spring 33. An O-ring 37 is placed in contact with the outer periphery of the plunger 31.

The tubular threaded member 41 (made, for example, of brass) has an external thread 41*a* provided on the outer periphery thereof to serve as an engagement member. The threaded member 41 is coaxially and movably fitted on the outer periphery of the slide shaft 22. At the same time, the threaded member 41 is in thread engagement with the internally threaded hole 12*a*1. When the lower end of the threaded member 41 is set flush with the lower surface of the shelf portion 12*a* as shown in FIG. 2 by way of example, the liquid suction/discharge volume is set at a maximum level, as stated later. In other words, FIG. 2 shows the initial state of the hybrid pipette 1 when the liquid suction/discharge volume is set at a maximum level in both the manual and motor-driven operation modes. It should be noted that an axially extending cut portion 41*b* (see FIG. 4) is formed in a part of the cross-section of the threaded member 41. By using the cut portion 41*b*, the threaded member 41 is rotatable together with a second gear 52*b* of a transmission gear mechanism 52 as one unit at all times as described later.

It should be noted that the arrangement of the engagement mechanism is not necessarily limited to the above-described arrangement formed from the tubular threaded member 41 and the internally threaded hole 12*a*1. For example, a rack-and-pinion mechanism may be used as the engagement mechanism. In such a case, for example, a rack member having an axially extending rack provided on the outer periphery of a member of continuous length is used as an engagement member in place of the tubular threaded member 41. The rack member is inserted into a simple through-hole provided in the casing shelf portion 12*a* in place of the internally threaded hole 12*a*1, and a pinion connected to the electric motor 51 is meshed with the rack. Thus, the rack member is movable vertically through the rack-and-pinion mechanism in response to the rotation of the pinion. In this case, the rack member may have a tubular shape. However, the shape of the rack member is not necessarily limited thereto. The rack member may also have a U- or C-shaped sectional configuration or a simple plate- or bar-like shape.

Figure 6:
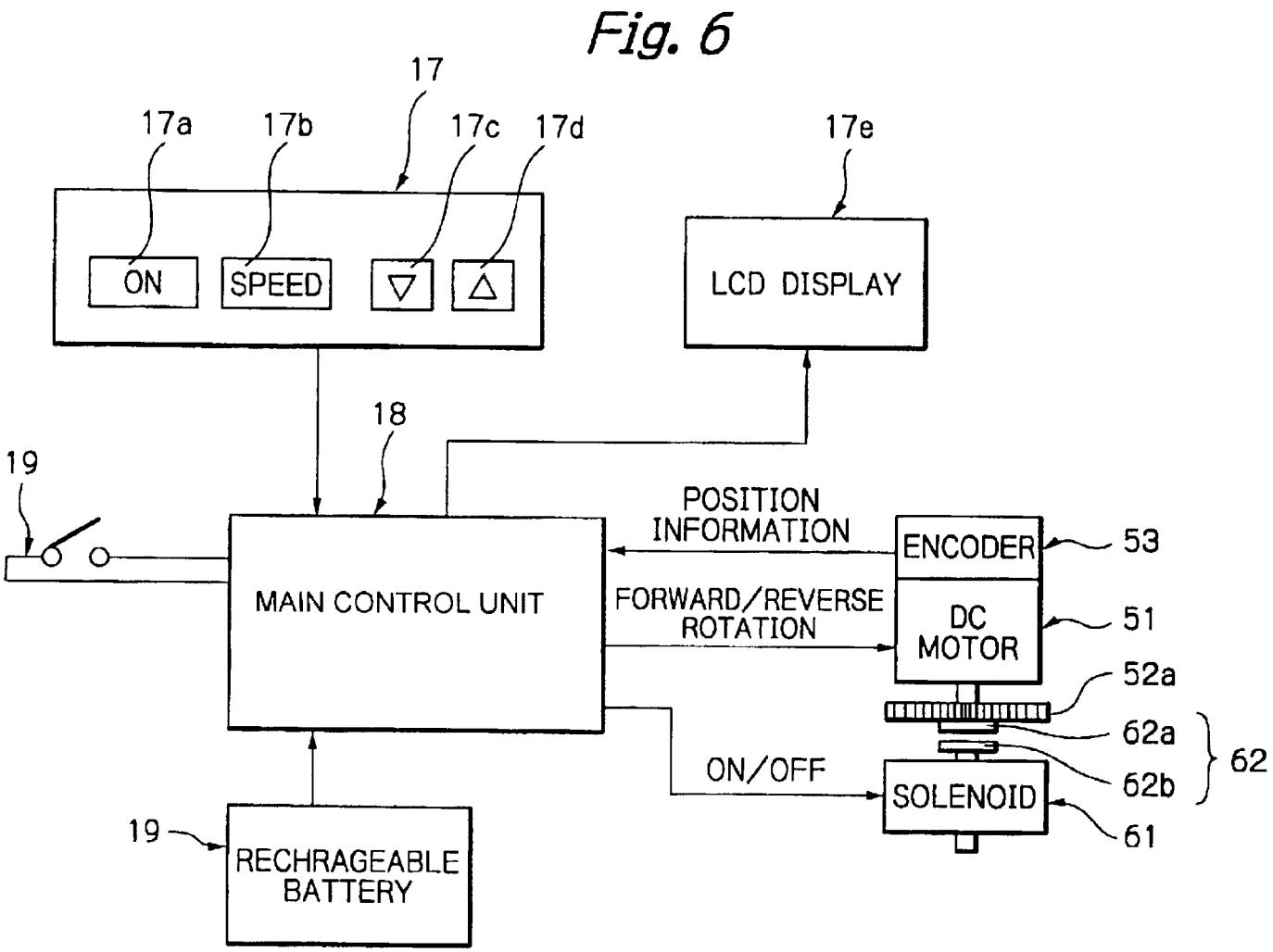
FIG. 6 is a block diagram showing a control circuit of the hybrid pipette shown in FIG. 1.

The electric motor 51 is a small-sized direct-current (DC) motor capable of producing a relatively large torque. The electric motor 51 is accommodated in the upper casing member 12. A first gear 52*a* and an upper clutch 62*a* are coaxially secured to a rotating output shaft 51*a* so as to be rotatable together as one unit. It should be noted that motor-driven pipettes generally use a pulse motor for this purpose, which allows easy rotational position control to discharge a predetermined amount of liquid from the pipettes accurately. In the present invention, however, a DC motor is used for the reason stated below. Because a pulse motor has relatively small torque, if such a heavy load as to compress the springs 33 and 34 (these are originally or essentially needed only in manual pipettes) is imposed thereon in the motor-driven operation mode, the pulse motor may happen to stop undesirably. Therefore, the use of a pulse motor is disadvantageous from a practical viewpoint. For this reason, a DC motor capable of producing a relatively large torque is used in the present invention. However, because accurate rotational position control cannot be performed with a DC motor, an encoder 53 is used in combination with the DC motor as shown in FIG. 6. That is, the rotational position of the motor output shaft 51*a* is detected with the encoder 53, and the motor 51 is forcedly stopped at an accurate position by using a brake mechanism 62 (described later). However, if a pulse motor capable of producing a sufficiently large torque is available, it is usable as the motor 51.

Figure 4:
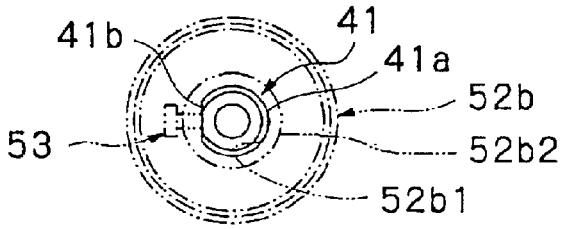
FIG. 4 is a plan view of a tubular threaded member of the hybrid pipette shown in FIG. 1.
Figure 5:
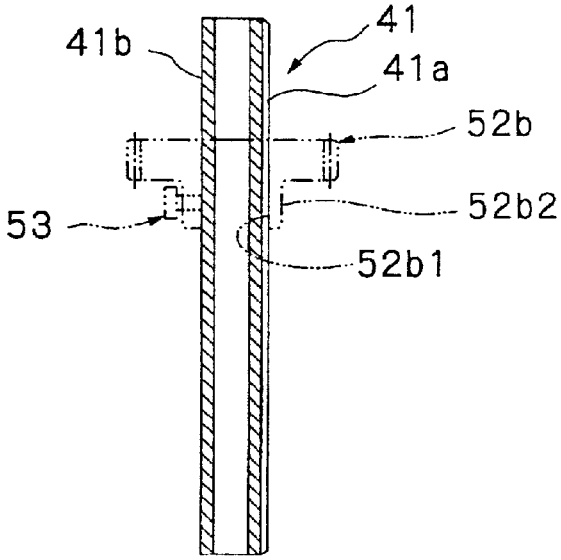
FIG. 5 is a vertical sectional view of the tubular threaded member of the hybrid pipette shown in FIG. 1.

The transmission gear mechanism 52 includes a first gear 52*a* and a second gear 52*b* that are meshed with each other. As shown in FIGS. 4 and 5, the second gear 52*b* has a center hole 52*b*1 relatively loosely fitted on the outer periphery of the threaded member 41. A screw 53 is screwed into a hub portion 52*b*2 of the second gear 52*b* until the distal end of the screw 53 abuts on the cut portion 41*b*, whereby the second gear 52*b* and the threaded member 41 are rotatable together as one unit at all times. It should be noted that the cut portion 41*b* may be formed as a groove instead of being a simple flat surface so that the screw 53 is engaged in the groove. When actually assembled, the second gear 52*b* is accommodated in the space between the pair of shelf portions 12*a* and 12*b* of the upper casing member 12 and unable to move vertically. Accordingly, when the second gear 52*b* is rotated by the electric motor 51, the threaded member 41 rotates together with the second gear 52*b* as one unit. As it rotates, the threaded member 41 moves vertically through thread engagement with the threaded hole 12*a*1. Even in this case, the second gear 52*b* does not move in the vertical direction. Although the transmission ratio of the transmission gear mechanism 52 is 1:1 in this case, it should be noted that the transmission gear mechanism 52 may be arranged to reduce or increase speed. It is also possible to use a mechanism other than the gear mechanism, e.g. a sprocket-chain mechanism.

A solenoid 61 is similarly accommodated and secured in the upper casing member 12 to face the electric motor 51. A lower clutch 62*b* is coaxially secured to a vertically movable output shaft 61*a* of the solenoid 61.

The brake mechanism 62 immediately stops the electric motor 51 upon completion of the operation thereof. The brake mechanism 62 includes the above-described upper and lower clutches 62*a* and 62*b*, which face each other across a gap in a normal state and engage each other when the brake mechanism 62 is actuated. In this embodiment, the upper clutch 62*a* has eight pin portions 62*a*1 equally arranged in the circumferential direction. The lower clutch 62*b* has eight radial grooves 62*b*1 equally arranged in the circumferential direction. Accordingly, when the lower clutch 62*b* moves upward toward the upper clutch 62*a* as the solenoid 61 is activated, the pin portions 62*a*1 of the upper clutch 62*a* come in engagement with the radial grooves 62*b*1 of the lower clutch 62*b*, respectively, thereby forcedly stopping the rotational motion of the upper clutch 62*a*, that is, the electric motor 51. It should be noted that the clutch device used in the present invention is not necessarily limited to the above-described engagement type using a solenoid but may be any of various other known clutches.

An ejector mechanism 71 is used to remove the tip 81. The ejector mechanism 71 includes an ejector shaft 73 provided with an ejector button 72 and an ejector housing 74. By pushing down the ejector button 72, the ejector housing 74 is pushed down, and thus the used tip 81 can be removed as occasion demands.

Next, the operation of the hybrid pipette 1 will be described.

First, a setting of a suction/discharge volume will be described. This setting is performed by using the control panel 17 and the electric motor 51 as stated below in common between the manual operation mode and the motor-driven operation mode. In FIG. 6, after the power switch 17*a* has been turned on, the speed of the threaded member 41 (plunger 31) is set with the speed setting switch 17*b*, and a suction/discharge volume is set by using the volume varying switches 17*c* and 17*d*. A signal indicating the set volume is sent to the main control unit 18, which contains a computer. After processing the signal, the main control unit 18 sends a signal to the electric motor 51 to instruct it how many revolutions the electric motor 51 should make in the forward direction, for example. Consequently, the electric motor 51 makes a given number of revolutions in the forward direction, and the threaded member 41 and the plunger 31 move downward through a predetermined distance from the position shown in FIG. 2 through the transmission gear mechanism 52 to define an initial position and stops at this position. Accordingly, when starting the suction, the plunger 31 begins to move downward from the initial position, and after the suction, the plunger 31 returns to the initial position. To discharge the sucked liquid, the plunger 31 moves downward again from the initial position to discharge a predetermined amount of liquid for each pipetting operation.

Figure 7:
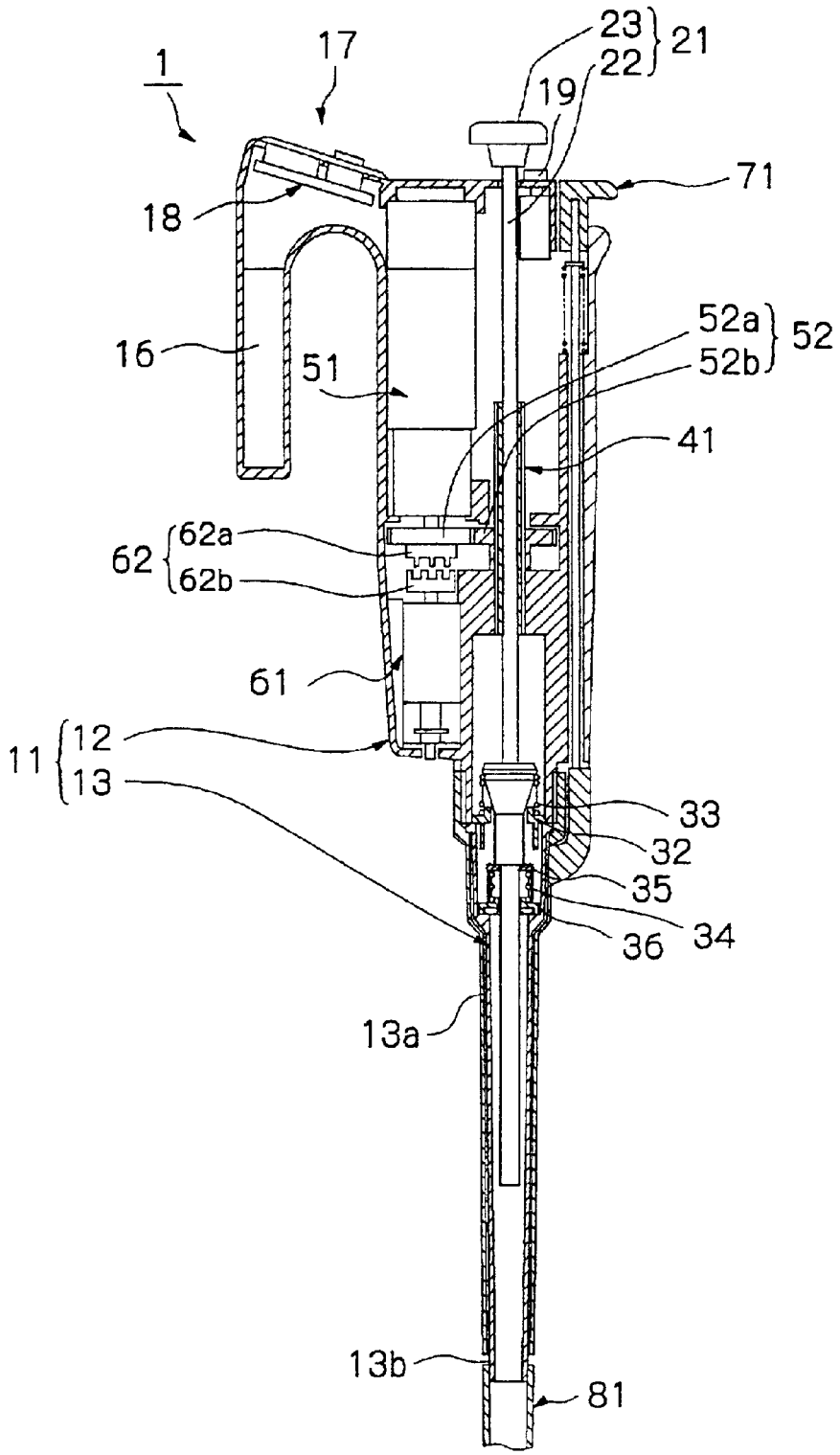
FIG. 7 is a vertical sectional view corresponding to FIG. 2, showing a state upon completion of a discharge operation of the hybrid pipette in FIG. 1 when it is used in a manual operation mode with the suction/discharge volume set at a maximum level.
Figure 8:
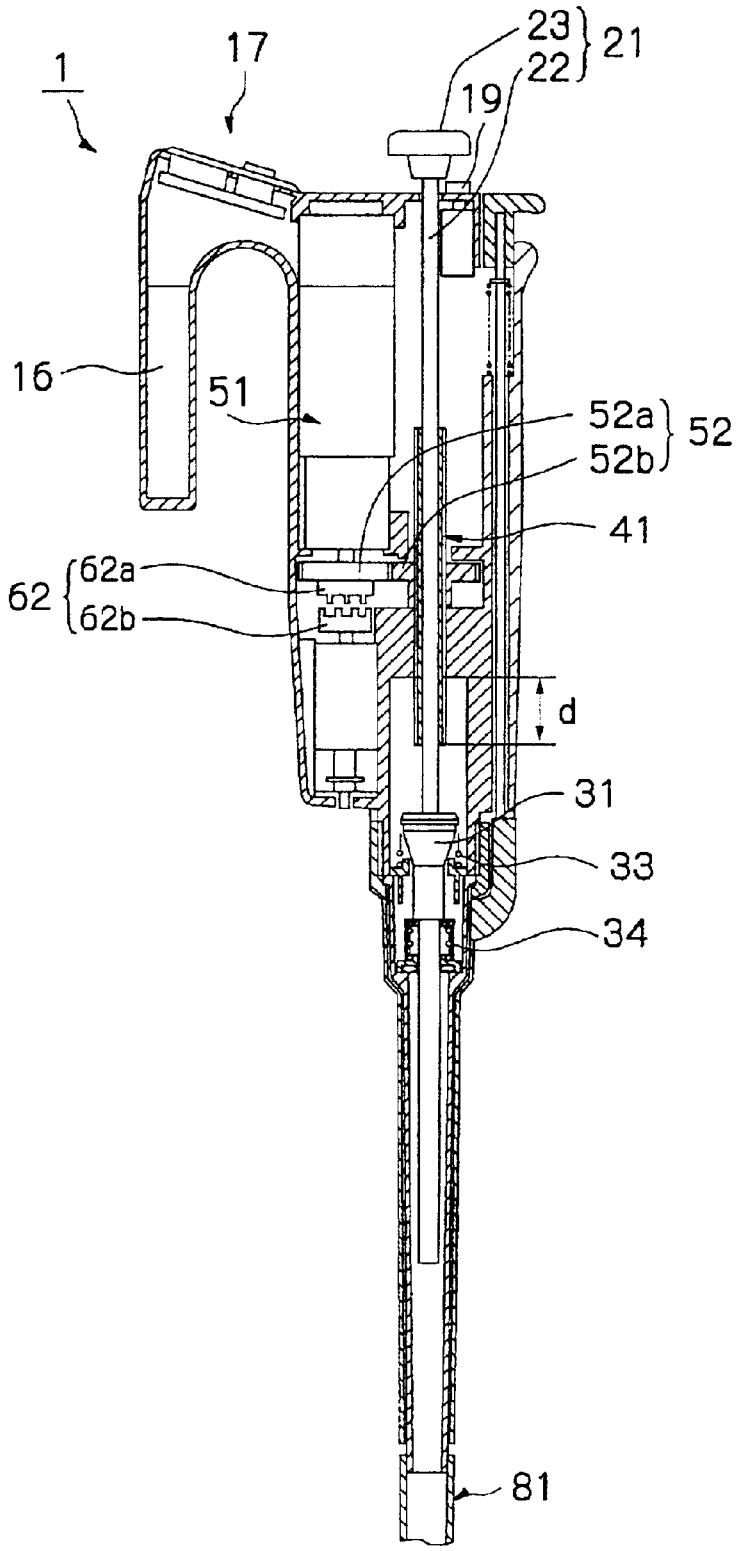
FIG. 8 is a vertical sectional view corresponding to FIG. 2, showing a state upon completion of a discharge operation of the hybrid pipette in FIG. 1 when it is used in a manual operation mode with the suction/discharge volume set at an intermediate level.

FIG. 7 shows the state of the hybrid pipette when the initial position of the threaded member 41 is set at the maximum height position, i.e. when the lower end of the threaded member 41 is set flush with the lower surface of the shelf portion 12*a*, the same as the case of FIG. 2, that is, when the suction volume is set at a maximum level, in the manual operation mode. FIG. 8 shows the state of the hybrid pipette when the initial position of the threaded member 41 is set at a predetermined height position which is a dimension d below the maximum height position, that is, when the suction volume is set at an intermediate level, in the manual operation mode. It should be noted that FIGS. 7 and 8 each show the discharge completion state where the plunger 31 has already been pushed down by the slide assembly 21, as stated below. It is, needless to say, possible to set the initial position of the threaded member 41 at a position lower than the position shown in FIG. 8. However, illustration of the arrangement for such setting is omitted.

Next, suction and discharge operations carried out after the suction/discharge volume setting will be described with regard to the manual operation mode first. In the initial state shown in FIG. 2, the slide assembly 21 is moved downward to the position shown in FIG. 7 by pushing down the pushbutton 23. Then, the lower end of the tip 81 is immersed in a sample liquid, and in this state, the slide assembly 21 is returned to the position shown in FIG. 2. Consequently, an amount of liquid equal to the desired quantity set on the control panel 17 (a maximum volume in this case) is sucked into the cylinder 13*a*.

Subsequently, the slide assembly 21 is moved downward by a predetermined distance at each of the push-down operations of the pushbutton 23, whereby a predetermined amount of liquid is discharged from the tip 81 for each of the push-down operations of the pushbutton 23. It should be noted that a whole downward motion of the slide assembly 21 performs a two-stage discharge operation. That is, the slide assembly 21 moves downward against only the first-stage spring 33 until the lower step portion 31*a* (see FIG. 2) of the plunger 31 abuts onto the spring retainer 35. After the lower step portion 31*a* has abutted onto the spring retainer 35, the slide assembly 21 moves downward against the two springs 33 and 34 to drain off the liquid remaining in the tip 81.

An operation similar to the above takes place also in a case where an intermediate suction/discharge volume is set in the manual operation mode as shown in FIG. 8 (i.e. the lower end of the threaded member 41 is positioned by a distance d below relative to the lower surface of the shelf portion 12*a* in the initial state). FIG. 8 shows a state where the slide assembly 21 has reached the limit of the downward movement upon completion of the two-stage discharge operation.

Figure 9:
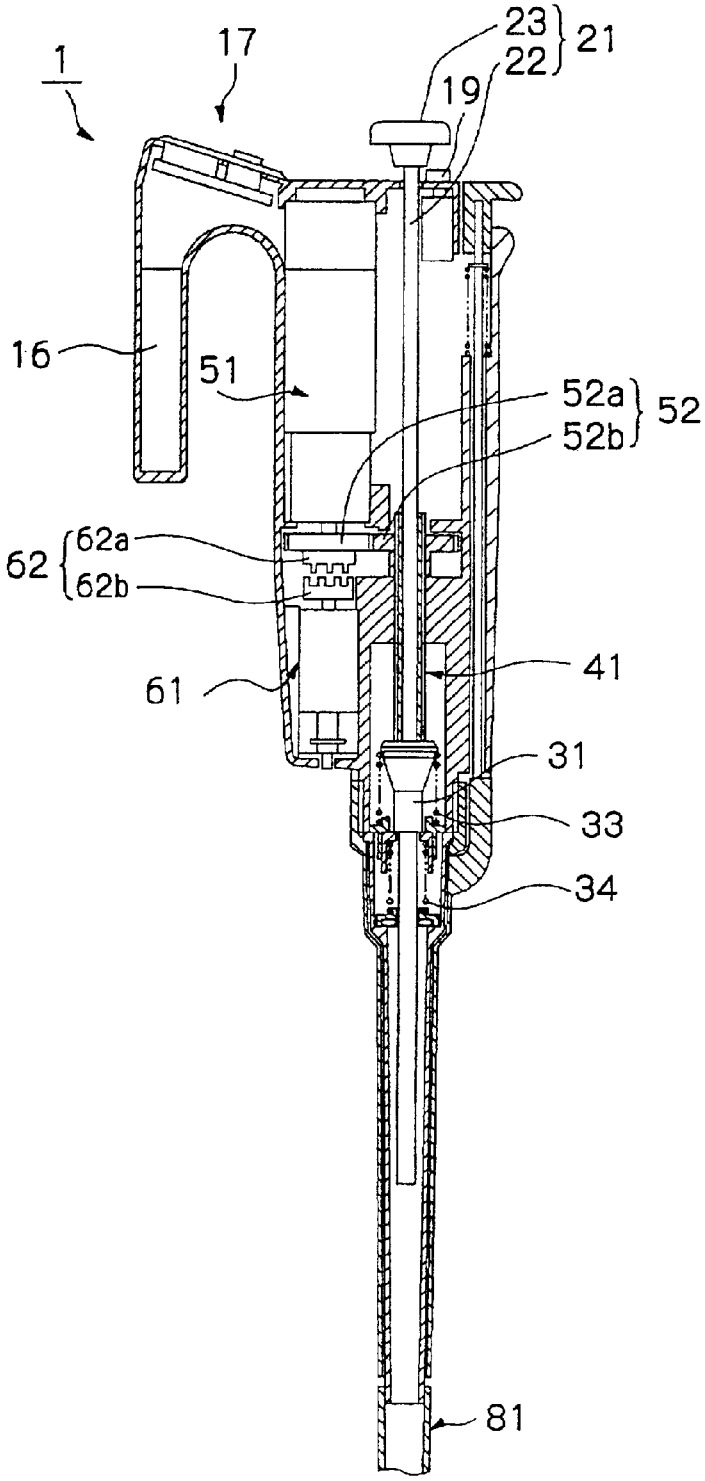
FIG. 9 is a vertical sectional view corresponding to FIG. 2, showing a state upon completion of a discharge operation of the hybrid pipette in FIG. 1 when it is used in a motor-driven operation mode.

Next, suction and discharge operations in the motor-driven operation mode will be described with reference to FIGS. 2 and 9. In the initial state shown in FIG. 2, when the motor 51 is driven to rotate in the forward direction, the threaded member 41 rotates in a predetermined direction through the transmission gear mechanism 52. Consequently, the threaded member 41 begins downward movement together with the plunger 31 as one unit apparently. When the plunger 31 reaches a predetermined position shown for example in FIG. 9, that is, a position where the lower step portion 31*a* of the plunger 31 just abuts onto the spring retainer 35, the motor 51 stops. Thus, the plunger 31 also stops. Incidentally, the threaded member 41 and the plunger 31 can further move downward a little more from a position shown in FIG. 9. In FIG. 9, the slide assembly 21 moves downward from the initial position shown in FIG. 2 only due to its own weight, following the threaded member 41.

Next, the lower end of the tip 81 is immersed in a sample liquid, and in this state, the motor 51 is driven in the reverse direction. Consequently, the threaded member 41 rotates in the reverse direction. Accordingly, the threaded member 41 begins upward movement, and the plunger 31 also moves upward by the spring action together with the threaded member 41 as one unit. When the threaded member 41 and plunger 31 return to the initial position shown in FIG. 2, the motor 51 stops. In this case, the suction speed should be set according to the level of viscosity of the liquid to be sucked. That is, when the viscosity of the liquid to be sucked is high, the suction speed should be set relatively low by using the speed setting switch 17*b* on the control panel 17. When the viscosity of the liquid to be sucked is low, the suction speed should be set relatively high.

Subsequently, the motor 51 is driven to rotate in the forward direction by an amount predetermined by the main control unit 18. Consequently, the threaded member 41 rotates in a predetermined direction to move downward by a predetermined amount together with the plunger 31 as one unit. Thus, as the plunger 31 moves downward by a predetermined amount at each of rotational movements of the threaded member 41, a predetermined amount of liquid is discharged from the tip 81 at each of rotational movements of the same. In this way, pipetting is carried out. Upon completion of discharging the whole amount of sucked liquid, the state shown in FIG. 9 is reached.

In the motor-driven operation mode, each time the motor 51 stops upon completion of discharging a predetermined amount of liquid as stated above, the brake mechanism 62 is activated. This is done for the following reason. Because the motor 51 is a DC motor and hence produces a relatively large torque, it would rotate due to inertia even after the supply of electric current has been cut off, causing an excess amount of liquid to be discharged undesirably. To prevent this, the brake mechanism 62 is used. More specifically, at the same time as the supply of electric current to the motor 51 is cut off, the solenoid 61 is energized under the control of the main control unit 18. Consequently, the output shaft 61*a* of the solenoid 61 moves upward, and the two clutches 62*a* and 62*b* engage each other, thereby forcedly stopping the rotation of the output shaft 51*a* of the motor 51. Thus, it is possible to ensure an accurate discharge quantity of liquid and hence possible to perform pipetting with high accuracy.

The same operation as stated above takes place also in a case where an intermediate suction/discharge volume is set in the motor-driven operation mode (i.e. the lower end of the threaded member 41 is positioned by a distance d below relative to the lower surface of the shelf portion 12*a* as in the case of FIG. 8). Therefore, illustration thereof is omitted.

Figure 11:
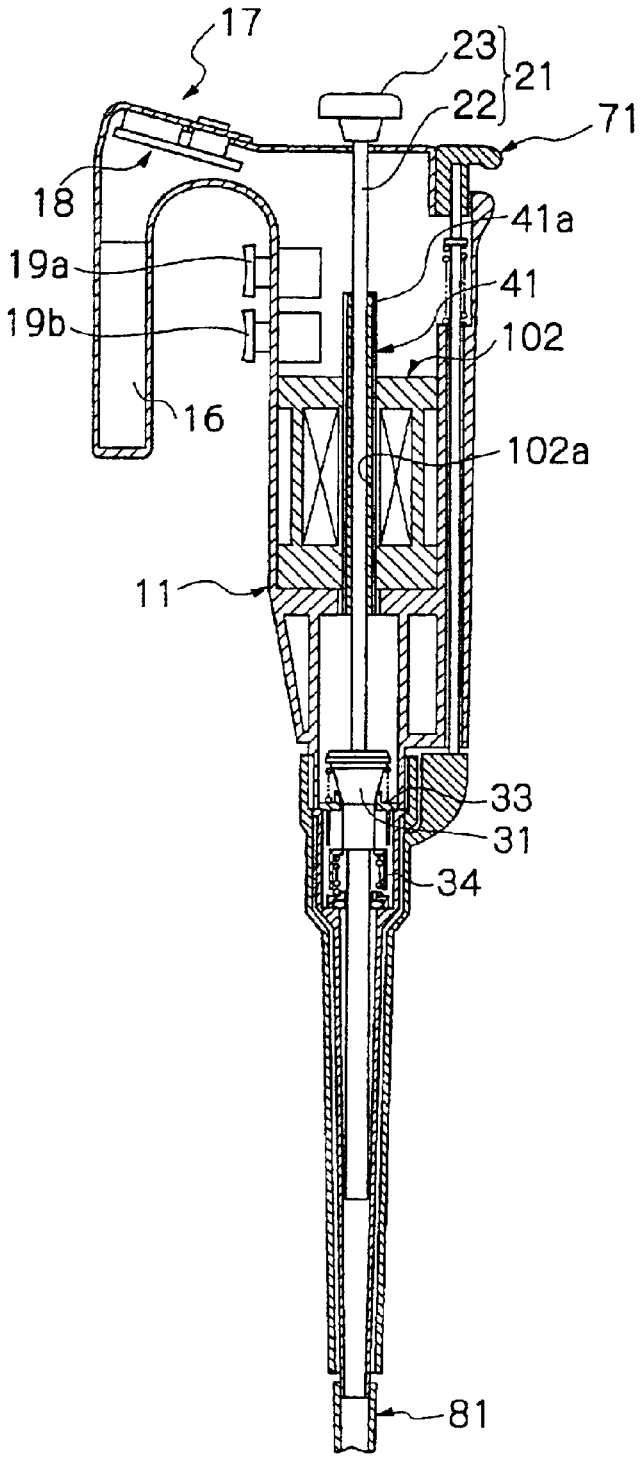
FIG. 11 is a vertical sectional view showing a state upon completion of a discharge operation of the hybrid pipette in FIG. 10 when it is used in a manual operation mode with the suction/discharge volume set at a maximum level.
Figure 12:
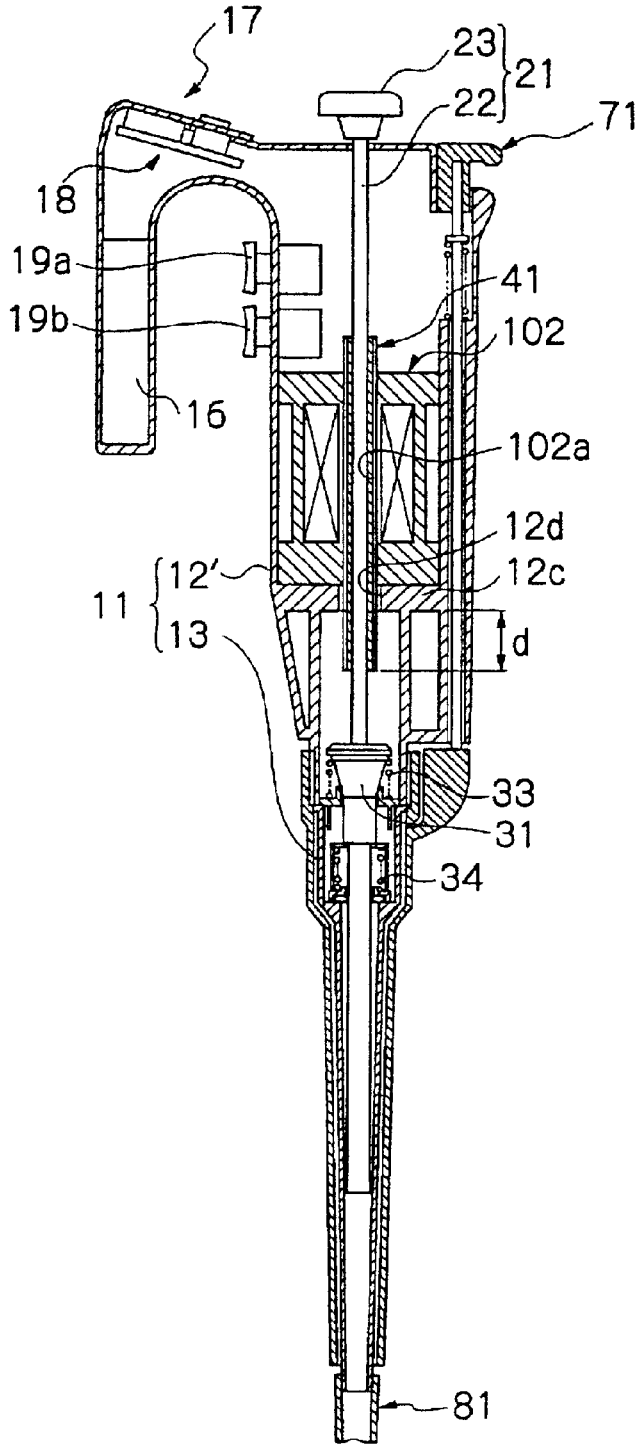
FIG. 12 is a vertical sectional view showing a state upon completion of a discharge operation of the hybrid pipette in FIG. 10 when it is used in a manual operation mode with the suction/discharge volume set at an intermediate level.

Next, a second embodiment of the present invention will be described with reference to FIGS. 10 to 12. In these figures, the same members or portions as those shown in FIGS. 1 to 9 are denoted by the same reference numerals, and a description thereof is omitted.

In a hybrid pipette 101 according to this embodiment, an electric motor 102 is a DC motor (or a pulse motor according to circumstances) and disposed in the center of the hybrid pipette 101 in coaxial relation thereto. A threaded member 41 (need not be provided with the cut portion 41*b* shown in FIGS. 4 and 5) is coaxially and movably fitted on a slide shaft 22 and extends through a central internally threaded hole 102*a* provided in the motor 102. The threaded member 41 is in thread engagement with the internally threaded hole 102*a*. Moreover, the threaded member 41 movably extends through a hole 12*d* in an intermediate shelf portion 12*c* of an upper casing member 12'. In place of the single suction/discharge operation switch 19 shown in FIG. 2, two switches that are assigned suction and discharge functions, respectively, i.e. a suction switch 19*a* and a discharge switch 19*b*, are provided on a side of the casing member 12'. According to this embodiment, the overall size of the hybrid pipette 101 can be reduced because the electric motor 102 is provided in the center of the pipette 101. In this case, the threaded member 41 rotates as a rotor of the motor 102 while moving vertically through thread engagement with the internally threaded hole 102*a*.

The arrangement and operation of the rest of this embodiment are the same as in the first embodiment (including the arrangement of the control panel 17, the main control unit 18 and the encoder 53 shown in FIG. 6) except that no brake mechanism is provided and the suction and discharge operations in the motor-driven operation mode are assigned to the two suction and discharge control switches 19*a* and 19*b*, respectively. The hybrid pipette 101 according to this embodiment may also be provided with a brake mechanism.

Figure 10:
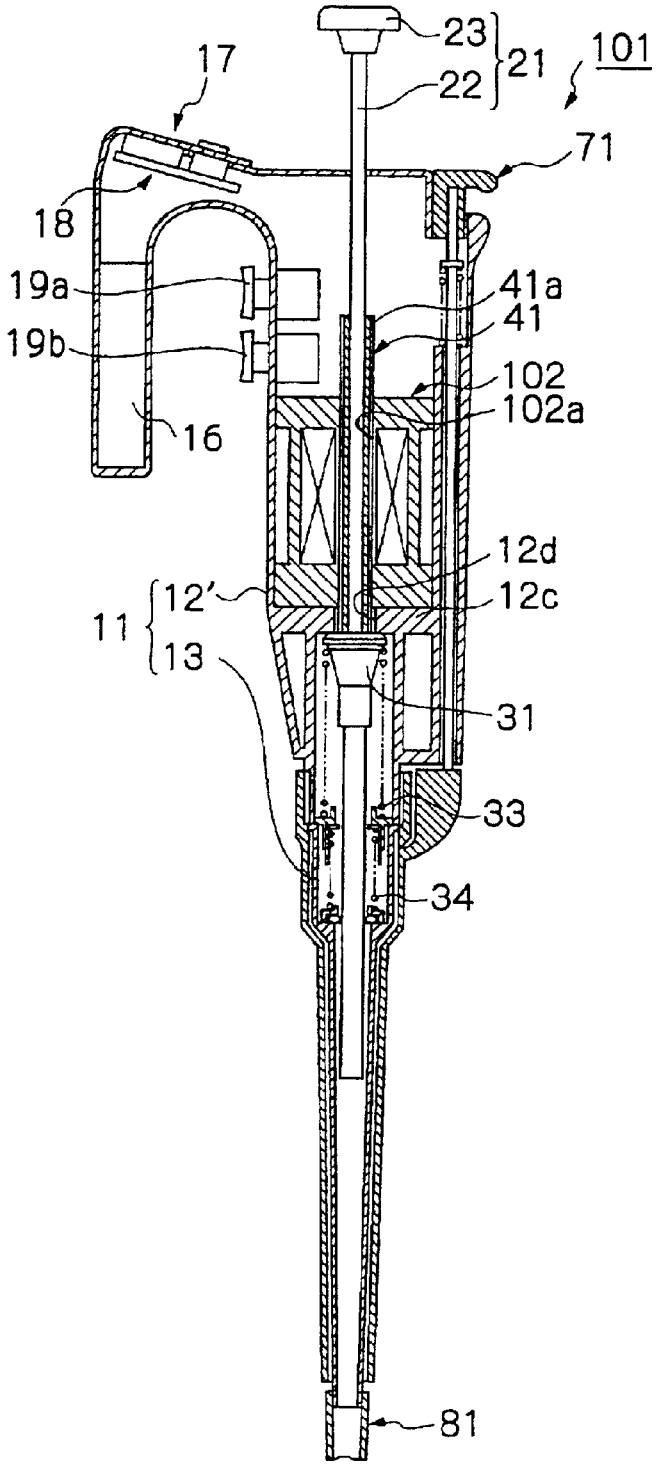
FIG. 10 is a vertical sectional view showing a second embodiment of the hybrid pipette according to the present invention in its initial position.
Figure 13:
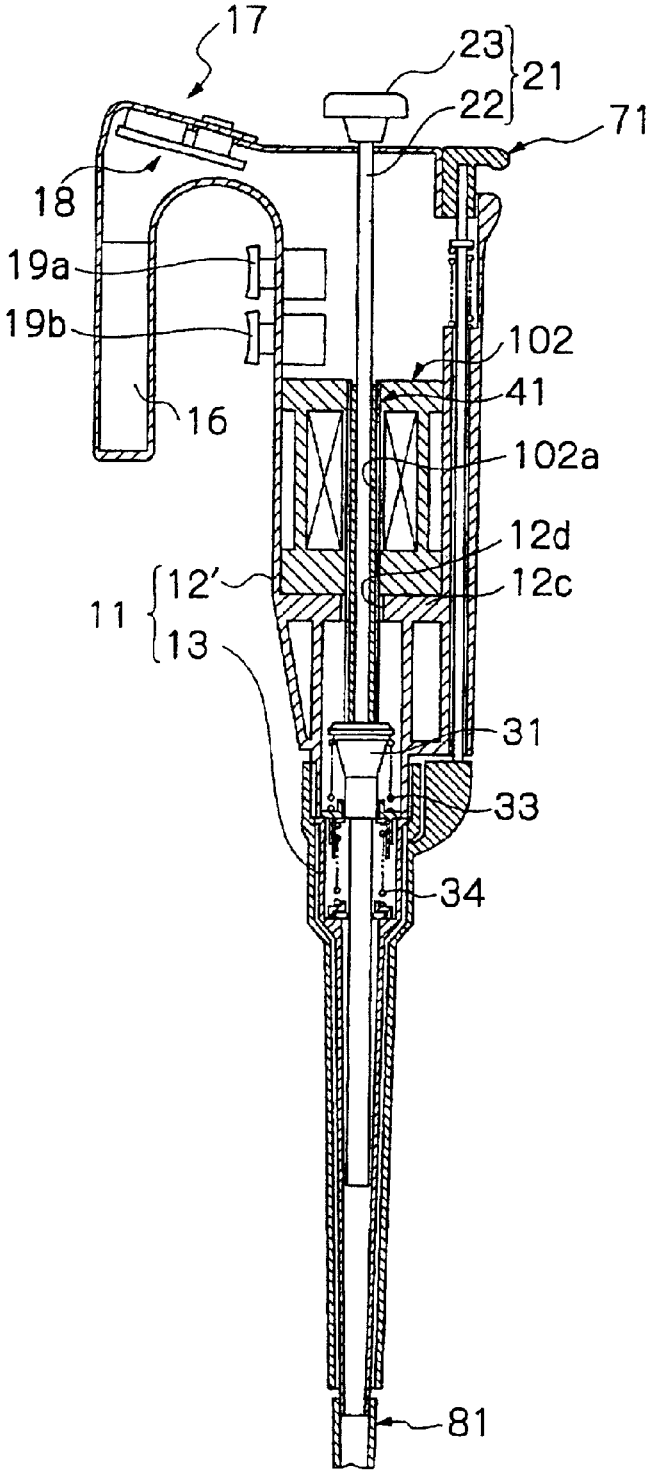
FIG. 13 is a vertical sectional view showing a state upon completion of a discharge operation of the hybrid pipette in FIG. 10 when it is used in a motor-driven operation mode.

It should be noted that FIG. 10 (corresponding to FIG. 2) shows the initial position of the hybrid pipette in both the manual operation mode and the motor-driven operation mode in a case where the suction/discharge volume is set at a maximum level. FIG. 11 (corresponding to FIG. 7) shows a state upon completion of the discharge operation of the hybrid pipette in the manual operation mode with the suction/discharge volume set at a maximum level. FIG. 12 (corresponding to FIG. 8) shows a state upon completion of the discharge operation of the hybrid pipette in the manual operation mode with the suction/discharge volume set at an intermediate level (i.e. the lower end of the threaded member 41 is set by a distance d below relative to the lower surface of the shelf portion 12*c*). FIG. 13 (corresponding to FIG. 9) is a state upon completion of the discharge operation of the hybrid pipette in the motor-driven operation mode.

Figure 14:
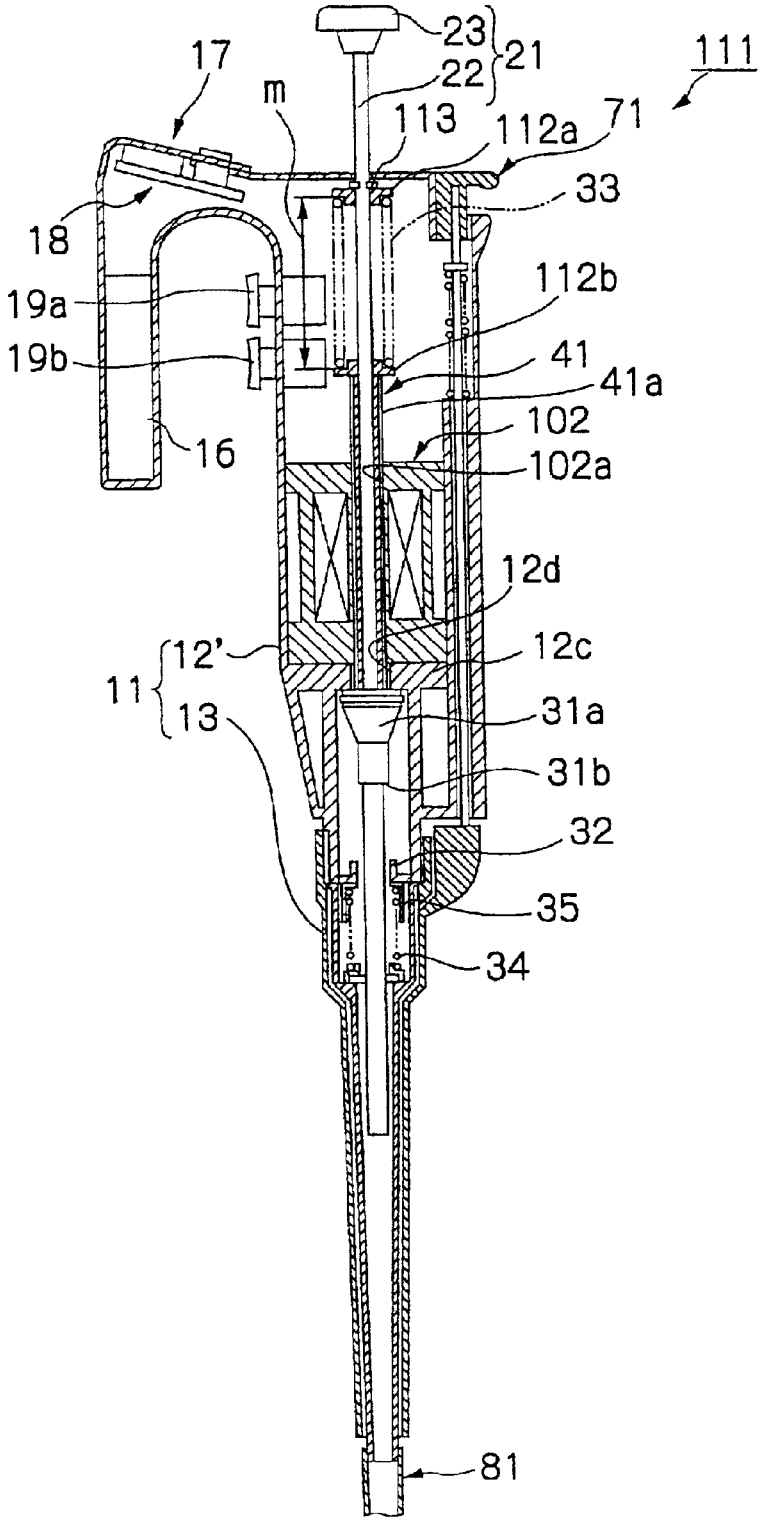
FIG. 14 is a vertical sectional view showing a third embodiment of the hybrid pipette according to the present invention in its initial position.

FIG. 14 shows a third embodiment of the hybrid pipette according to the present invention in its initial position. In the figure, the same members or portions as those shown in FIG. 10 are denoted by the same reference numerals, and a description thereof is omitted.

In the hybrid pipette 101 (FIG. 10) according to the second embodiment, the first-stage spring 33 is disposed between the plunger 31 and the spring retainer 32, that is, below the threaded member 41. In addition, the shaft 22 and the plunger 31 are provided as separate members. In the hybrid pipette 111 (FIG. 14) according to the third embodiment, on the other hand, the first-stage spring 33 is interposed between a pair of spring retainers 112*a* and 112*b* fitted on the shaft 22 above the threaded member 41. Moreover, the shaft 22 and the plunger 31*a* are fabricated integrally as a single member. In this case, an electric motor 102 is a pulse motor, not a direct current motor, for the reason that a necessary driving torque of the motor 102 may be relatively small as mentioned hereinbelow and, therefore no braking mechanism is provided. However, even in this case, the direct current motor could be adopted together with a brake mechanism as shown in FIG. 10.

Accordingly, urging force from the first-stage spring 33 causes the upper spring retainer 112*a* to abut against an E-ring 113 mounted on the shaft 22 and also causes the lower spring retainer 112*b* to abut against the upper end of the threaded member 41. At the same time, the shaft 22 and the plunger 31*a*, which are integral with each other, are urged upwardly by the first-stage spring 33. In this case, the upper end of the plunger 31*a* is kept abutting against at least either one of the lower end of the threaded member 41 and the lower surface of the shelf portion 12*c* (see FIG. 14) by the urging force. It should be noted that the installation position of the first-stage spring 33 is not necessarily limited to the position above the threaded member 41 but may be below the threaded member 41. The essential thing is to provide a space capable of accommodating the spring 33 and to interpose the spring 33 between the threaded member 41 and the shaft 22 or the plunger 31*a* in the space.

The operation of the hybrid pipette 111 in the manual operation mode is similar to that in the second embodiment shown in FIG. 10. That is, in the initial state shown in FIG. 14, the slide assembly 21, together with the plunger 31*a*, is moved downward against only the first-stage spring 33 at the beginning and then against both the springs 33 and 34 so as to reach the position shown in FIG. 15. Then, the slide assembly 21 is allowed to move upward to return to the initial position. Consequently, an amount of liquid equal to the desired quantity (a maximum volume in this case) is sucked into the cylinder 13*a*.

Subsequently, the slide assembly 21 is moved downward by a predetermined distance at each of the push-down operations of the pushbutton 23, whereby a predetermined amount of liquid is discharged from the tip 81 for each of the push-down operations of the pushbutton 23. During the pipetting operation, the slide assembly 21 moves in the same way as in FIGS. 10 and 11. That is, the slide assembly 21 moves downward against only the first-stage spring 33 until the lower step portion 31*b* of the plunger 31*a* abuts onto the spring retainer 35. After the lower step portion 31*b* has abutted onto the spring retainer 35, the slide assembly 21 moves downward against the two springs 33 and 34. It should be noted that this embodiment also allows an intermediate suction/discharge volume to be set in the manual operation mode in the same way as in FIG. 8.

Next, suction and discharge operations in the motor-driven operation mode will be described with reference to FIG. 16. In the initial state shown in FIG. 14, when the motor 102 is driven to rotate in the forward direction, for example, the threaded member 41 rotates in a predetermined direction. Consequently, the threaded member 41 begins downward movement in a state where the relative position of the threaded member 41 with respect to the shaft 22 and the plunger 31*a* is kept constant by spring force of the first-stage spring 33, that is, in a state where the three members 41, 22 and 31*a* are apparently unitary. When the plunger 31*a* reaches a predetermined position shown for example in FIG. 16, that is, a position where the lower step portion 31*b* of the plunger 31*a* just abuts onto the spring retainer 35, the motor 102 stops. Thus, the plunger 31*a* also stops. (Incidentally, the threaded member 41 and the plunger 31*a* could further move downward a little more from the position shown in FIG. 16.)

Next, the lower end of the tip 81 is immersed in a sample liquid, and in this state, the motor 102 is driven in the reverse direction. Consequently, the threaded member 41 rotates in the reverse direction. Accordingly, the threaded member 41 begins upward movement. At this time, the three members 41, 22 and 31*a* move upward while being kept apparently unitary by the spring force of the first-stage spring 33 in the same way as in the downward movement. When the three members 41, 22 and 31*a* return to the initial position shown in FIG. 14, the motor 102 stops. In this case also, the suction speed can be variably set with the speed setting switch 17*b* on the control panel 17 according to the level of viscosity of the liquid to be sucked.

Subsequently, the motor 102 is driven to rotate in the forward direction by an amount predetermined by the main control unit 18. Consequently, the threaded member 41 rotates in a predetermined direction, and the three members 41, 22 and 31*a* move downward by a predetermined amount while being kept apparently unitary. Thus, as the plunger 31*a* moves downward by a predetermined amount at each of rotational movements of the threaded member 41, a predetermined amount of liquid is discharged from the tip 81 at each of rotational movements of the same. In this way, pipetting is carried out. Upon completion of discharging the whole amount of sucked liquid, the state shown in FIG. 16 is reached. In this embodiment also, a brake mechanism may be provided for use in the motor-driven operation mode. That is, each time the motor 102 stops upon completion of discharging a predetermined amount of liquid as stated above, the brake mechanism may be activated.

Figure 15:
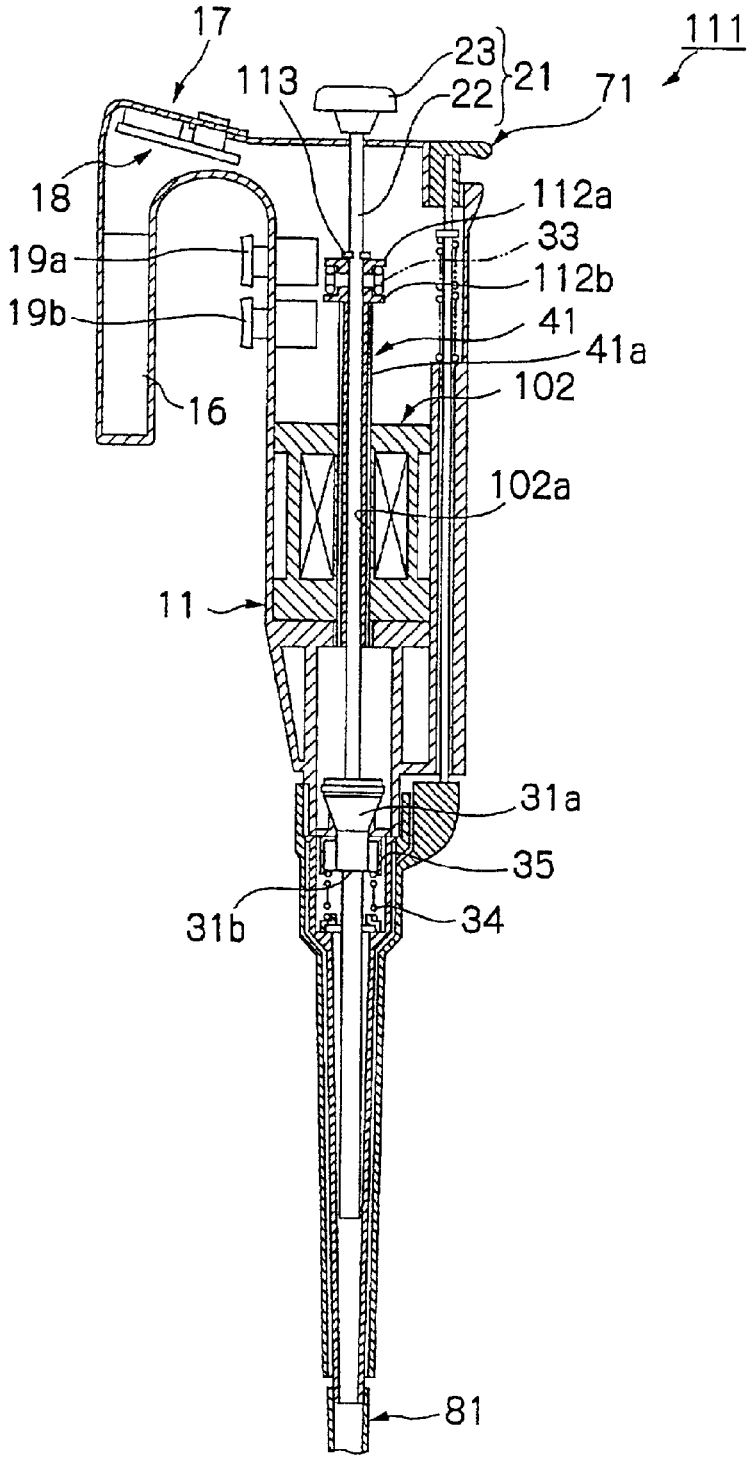
FIG. 15 is a vertical sectional view showing a state upon completion of a discharge operation of the hybrid pipette in FIG. 14 when it is used in a manual operation mode with the suction/discharge volume set at a maximum level.
Figure 16:
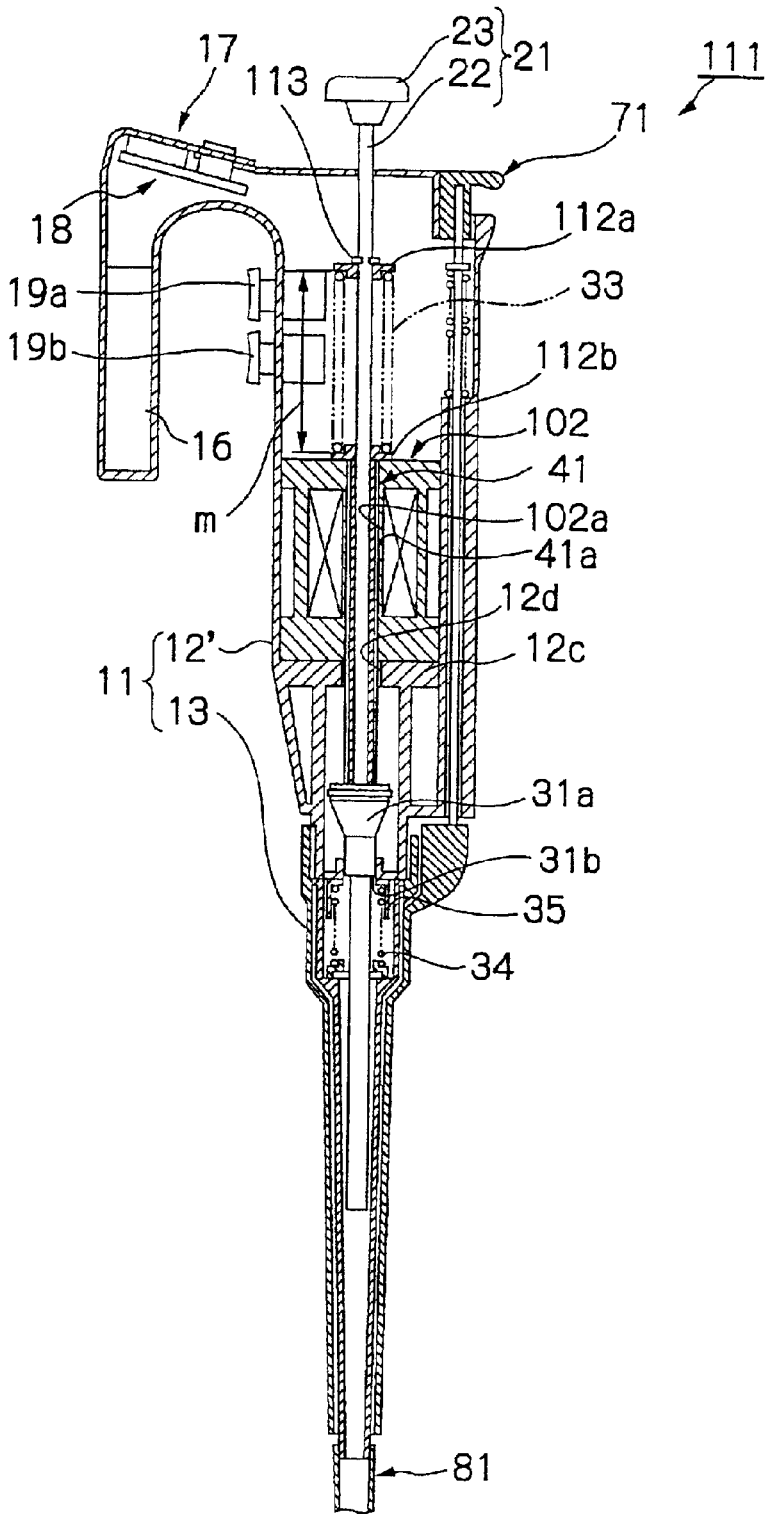
FIG. 16 is a vertical sectional view showing a state upon completion of a discharge operation of the hybrid pipette in FIG. 14 when it is used in a motor-driven operation mode.

The third embodiment shown in FIGS. 14 to 16 is substantially the same as the second embodiment shown in FIGS. 10 to 13 in terms of the operations of the springs 33 and 34 in the manual operation mode but different from the second embodiment in that when the slide assembly 21 moves vertically in the motor-driven operation mode, the three members 41, 22 and 31*a* move vertically while being kept apparently unitary at all times; therefore, no compressive force is applied to the first-stage spring 33. In other words, the first-stage spring 33 has a constant length m throughout the movement of the slide assembly 21 between the initial position (FIG. 14) and the lower limit position (FIG. 16). Accordingly, the third embodiment has an advantage in that the driving torque of the motor 102 can be reduced, that is, the size of the motor 102 can be reduced correspondingly. Accordingly, it has become possible in this case to use a pulse motor which can present relatively small driving torque.

Figure 17:
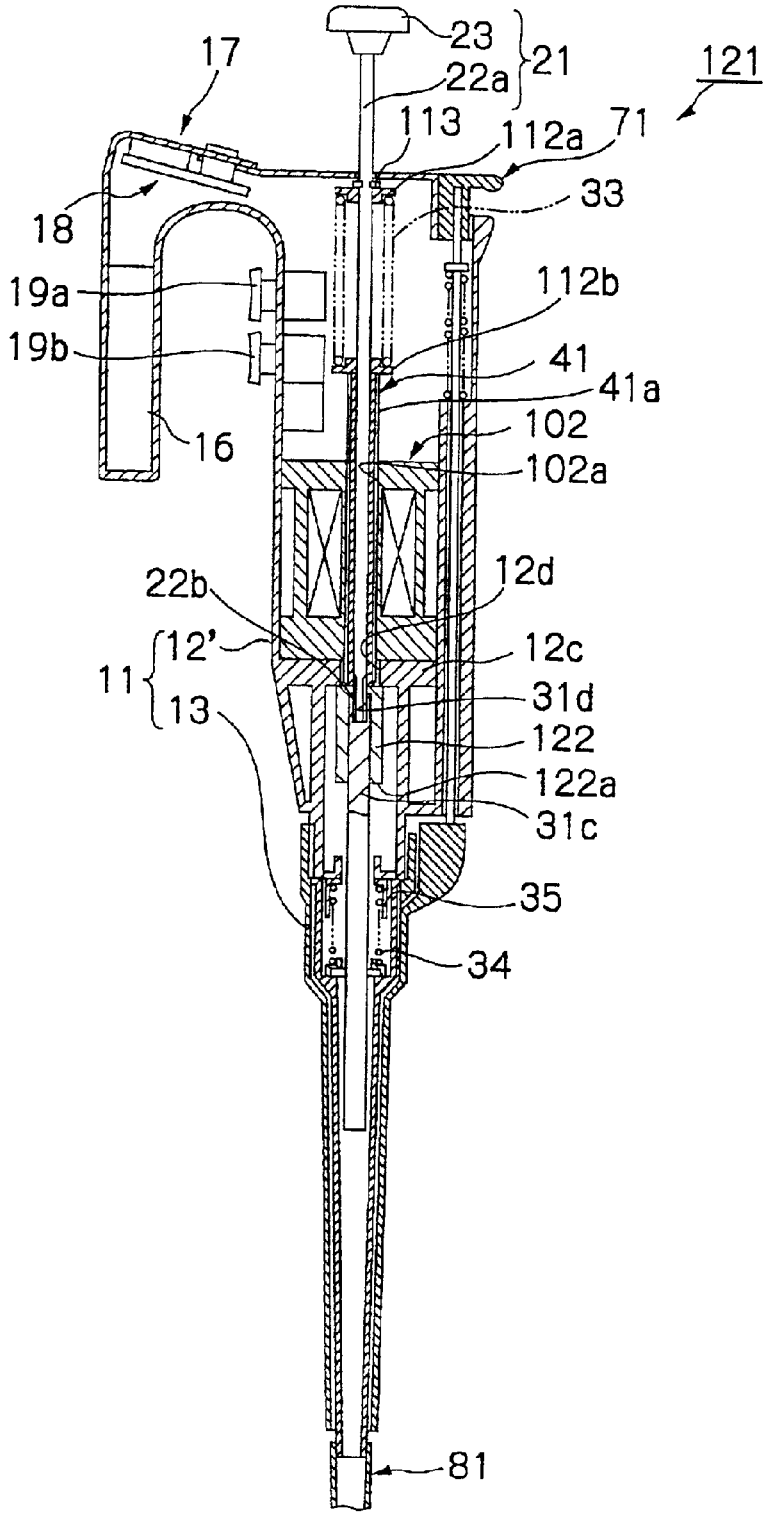
FIG. 17 is a vertical sectional view showing a modification of the hybrid pipette shown in FIG. 14 in its initial position.

FIG. 17 shows a hybrid pipette 121 as a modification of the embodiment shown in FIG. 14. In the figure, the same members or portions as those shown in FIG. 14 are denoted by the same reference numerals. In this modification, a shaft 22*a* and a plunger 31*c* are prepared as separate members. During assembly, an externally threaded portion 22*b* at the lower end of the shaft 22*a* is engaged with an internally threaded portion 31*d* at the upper end of the plunger 31*c* with a collar 122 interposed therebetween. The collar 122 is in the shape of a cylinder, one end of which is closed except for an opening for receiving the externally threaded portion 22*b* of the shaft 22*a*. In this way, the shaft 22*a* and the plunger 31*c* are joined together as one unit. It should be noted, however, that the shaft 22*a* and the plunger 31*c* can be joined together by various methods, e.g. by using a pin, in addition to the above-described thread engagement. With this modification, the overall pipette assembling operation is facilitated in comparison to the structure in which the shaft 22 and the plunger are integral with each other from the beginning. The operation of this modification is the same as that of the embodiment shown in FIG. 14. In this modification, however, the lower end 122*a* of the collar 122 performs a function similar to that of the lower step portion 31*b* of the plunger 31*a* shown in FIG. 14.

It should be noted that the present invention is not limited to the foregoing embodiments but can be modified in a variety of ways.

What is claimed is:

1. A hybrid pipette comprising:

a pipette casing;

a slide shaft vertically movable in response to an operation of a pushbutton;

a plunger disposed below said slide shaft, said plunger being vertically movable together with said slide shaft as one unit;

an electric motor provided in coaxial relation to said slide shaft, said electric motor having an internally threaded hole;

a tubular threaded member with an external thread on an outer periphery thereof, said tubular threaded member being coaxially and movably fitted on said slide shaft and being thread-engaged with the internally threaded hole in said electric motor to allow said slide shaft to move vertically; and at least one spring interposed between a predetermined position on said slide shaft and said tubular threaded member to urge said slide shaft and said plunger upwardly so that a predetermined portion of said slide shaft or said plunger abuts against a predetermined portion of said tubular threaded member or said pipette casing;

wherein, in a manual operation mode, said slide shaft and said plunger move vertically in response to the operation of said pushbutton to perform suction and discharge of a liquid; and wherein, in a motor-driven operation mode, said tubular threaded member is driven by said electric motor so as to move vertically, thereby said plunger is moved vertically to perform suction and discharge of a liquid, and the length of said spring is maintained constant with no extension or compression thereof in the motor-driven operation mode.

2. A hybrid pipette according to claim 1, wherein said at least one spring is interposed between an upper end of said tubular threaded member projecting above said electric motor and an upper portion of said slide shaft within said pipette casing.

3. A hybrid pipette according to claim 2, wherein said slide shaft and said plunger are fabricated integrally as a single member.

4. A hybrid pipette according to claim 2, wherein said slide shaft and said plunger are fabricated as separate members and joined together as one unit by screwing one of said slide shaft and said plunger into the other of them or by using a pin.

5. A hybrid pipette according to claim 2, wherein said electric motor is a direct-current motor, said direct-current motor being provided with a brake mechanism.

6. A hybrid pipette according to claim 2, wherein said electric motor is a pulse motor.

7. A hybrid pipette according to claim 2, further comprising a battery for driving said electric motor.

8. A hybrid pipette according to claim 1, wherein said slide shaft and said plunger are fabricated integrally as a single member.

9. A hybrid pipette according to claim 1, wherein said slide shaft and said plunger are fabricated as separate members and joined together as one unit by screwing one of said slide shaft and said plunger into the other of them or by using a pin.

10. A hybrid pipette according to claim 1, wherein said electric motor is a direct-current motor, said direct-current motor being provided with a brake mechanism.

11. A hybrid pipette according to claim 1, wherein said electric motor is a pulse motor.

12. A hybrid pipette according to claim 1, further comprising a battery for driving said electric motor.

* * * * *